US011219256B2

(12) United States Patent
Bethel

(10) Patent No.: US 11,219,256 B2
(45) Date of Patent: Jan. 11, 2022

(54) HALF MITTEN APPARATUS TO SAFELY DEMONSTRATE MOTORIST HANDS DURING A TRAFFIC STOP

(71) Applicant: James Bethel, Phoenix, AZ (US)

(72) Inventor: James Bethel, Phoenix, AZ (US)

( * ) Notice: Subject to any disclaimer, the term of this patent is extended or adjusted under 35 U.S.C. 154(b) by 745 days.

(21) Appl. No.: 15/897,648

(22) Filed: Feb. 15, 2018

(65) Prior Publication Data

US 2018/0228230 A1 Aug. 16, 2018

Related U.S. Application Data

(60) Provisional application No. 62/459,356, filed on Feb. 15, 2017.

(51) Int. Cl.

| | |
|---|---|
| ***A41D 19/015*** | (2006.01) |
| ***A41D 13/01*** | (2006.01) |
| ***A41D 19/00*** | (2006.01) |
| ***A41D 19/01*** | (2006.01) |

(52) U.S. Cl.

CPC ..... *A41D 19/0157* (2013.01); *A41D 13/01* (2013.01); *A41D 19/0006* (2013.01); *A41D 19/0034* (2013.01); *A41D 19/01* (2013.01); *A41D 2400/00* (2013.01)

(58) Field of Classification Search

CPC ..... A41D 19/0157; A41D 13/01; A41D 19/0006; A41D 19/0034; A41D 19/01; A41D 2400/00

See application file for complete search history.

(56) References Cited

U.S. PATENT DOCUMENTS

| | | | | |
|---|---|---|---|---|
| 2,501,565 | A * | 3/1950 | Halley | A41D 19/01 604/292 |
| 4,741,052 | A * | 5/1988 | Rubin | A41D 19/0006 2/158 |
| 6,976,274 | B1 * | 12/2005 | Dufresne | A41D 19/01535 2/161.6 |
| 2004/0084495 | A1 * | 5/2004 | Rudeen | A45F 5/00 224/668 |
| 2004/0172735 | A1 * | 9/2004 | Garland | A41D 19/0041 2/160 |
| 2007/0240247 | A1 * | 10/2007 | Beck | A41D 31/12 2/16 |
| 2014/0173804 | A1 * | 6/2014 | Matos | A41D 19/0034 2/158 |

* cited by examiner

*Primary Examiner* — Khoa D Huynh
*Assistant Examiner* — Erick I Lopez

(57) ABSTRACT

A half mitten apparatus to safely demonstrate motorist hands during a traffic stop includes a first half-mitten, a second half-mitten, and a flexible connector. The first half-mitten and the second half-mitten each comprises a visually accentuating outer layer, an inner layer, a finger receiving receptacle, and an eyelet. The visually accentuating outer layer is externally connected about the inner layer that delineates the finger receiving receptacle. The eyelet traverses through the visually accentuating outer layer and the inner layer, adjacent to an opened end of the finger receiving receptacle. The eyelet of the first half-mitten and the eyelet of the second half-mitten are tethered into each other by the flexible connector as the flexible connector fastens both the first half-mitten and the second half-mitten within the close proximity of each other.

6 Claims, 6 Drawing Sheets

HALF MITTEN APPARATUS TO SAFELY DEMONSTRATE MOTORIST HANDS DURING A TRAFFIC STOP

The current application claims a priority to the U.S. Provisional Patent application Ser. No. 62/459,356 filed on Feb. 15, 2017.

FIELD OF THE INVENTION

The present invention relates generally to a pair of mittens. More specifically, the present invention is a highly visible and reflective pair of mittens that allows a motorist to safely demonstrate their hands to a police officer during a traffic stop.

BACKGROUND OF THE INVENTION

A traffic stop is usually accomplished through a process known as "pulling over" the suspect's vehicle by a police vehicle. The police vehicles normally equipped with sirens, loudspeakers, and lightbars that rotate or flash to get the attention of the motorist of the suspected vehicle and other passing by the police vehicle. Depending upon the severity of the offense which the police officer believes to have occurred and any outstanding warrants associated with the vehicle, the police officers have to be extremely cautious when approaching the suspected vehicle. Due to many different prejudgment reasons and failing to follow given orders, whether it's the fault of the suspected motorist or the police officer, many fatalities and personal injuries have occurred on both sides during traffic stops. This is an ongoing problem for both motorists and police officers on a daily basis as existing solutions and regulations have failed to solve this problem.

It is therefore and objective of the present invention to provide a half mitten apparatus to safely demonstrate motorist hands during a traffic stop. More specifically, the present invention is highly visible and reflective pair of mittens that can be easily worn by the motorists during a traffic stop so safely display their hands to ease the tension between the motorist and police officer. The present invention also lessens the space within the pair of mittens and leaves the thumb outside of the mitten thus making it more difficult to conceal a weapon. Additionally, the pair of mittens is connected within close proximity of each other restricting hand movement. As a result, the present invention is able to demonstrate a safer environment for both the motorist and the police officer during a traffic stop.

DETAIL DESCRIPTIONS OF THE INVENTION

All illustrations of the drawings are for the purpose of describing selected versions of the present invention and are not intended to limit the scope of the present invention.

The present invention is a half mitten apparatus to safely demonstrate motorist hands during a traffic stop. More specifically, the present invention clearly shows the motorist's hand to police office during daytime and nighttime by unbaling the motorist to conceal a weapon and restricting the hand movement of the motorist throughout the traffic stop. As a result, the present invention creates a safer environment for both the motorist and the police officer.

Figure 1:
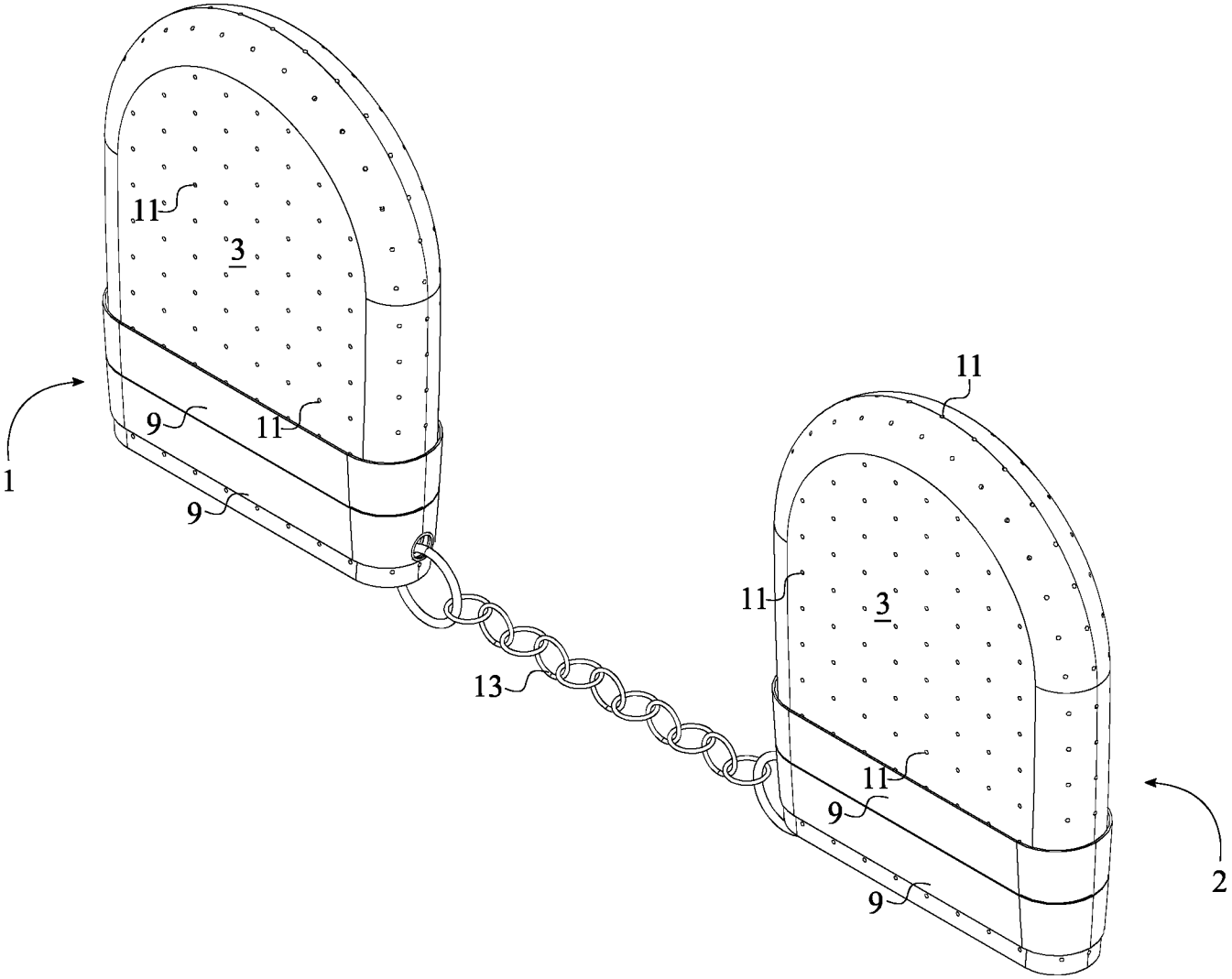
FIG. 1 is a front perspective view of the present invention.
Figure 2:
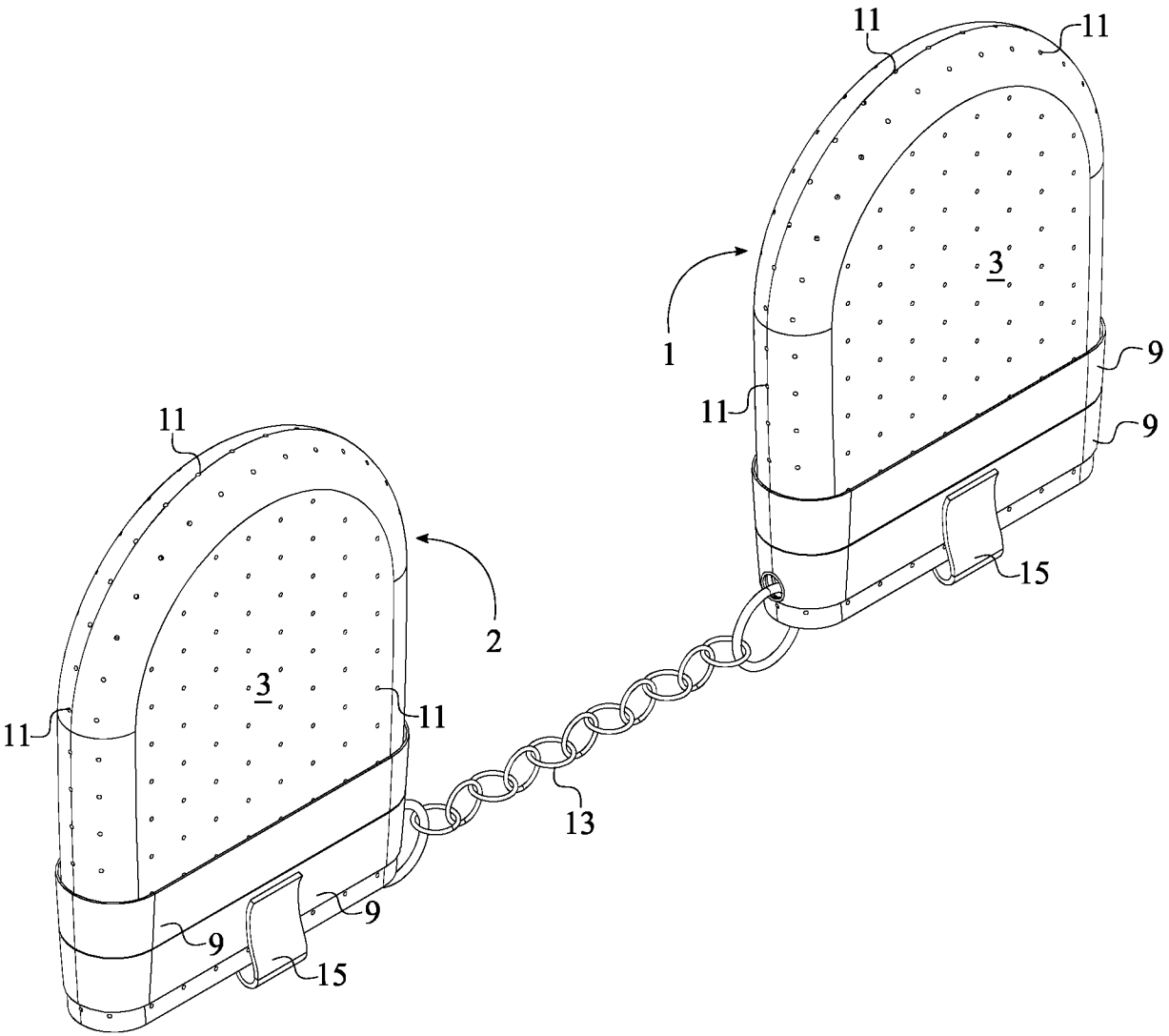
FIG. 2 is a rear perspective view of the present invention.

The present invention comprises a first half-mitten 1, a second half-mitten 2, and a flexible connector 13 as shown in FIG. 1-2. The first half-mitten 1 and the second half-mitten 2 are designed only to the cover the figures of the motorist thus leaving the palm and the thumb exposed. More specifically, the first half-mitten 1 and the second half-mitten 2 delineate an inverted U-shaped body so that the motorist can easily insert their finger into the first half-mitten 1 and the second half-mitten 2. In reference to the general configuration of the present invention, the first half-mitten 1 and the second half-mitten 2 are connected to each other through the flexible connector 13. Additionally, a length of the flexible connector 13 ranges from 6 inches to 8 inches thus minimizing the movement between the first half-mitten 1 and the second half-mitten 2. As a result of the shortened length of the flexible connector 13, the police officer can easily eliminate any kind of unwanted or destructive hand movement from the motorist when the present invention is utilized by the motorist.

Figure 3:
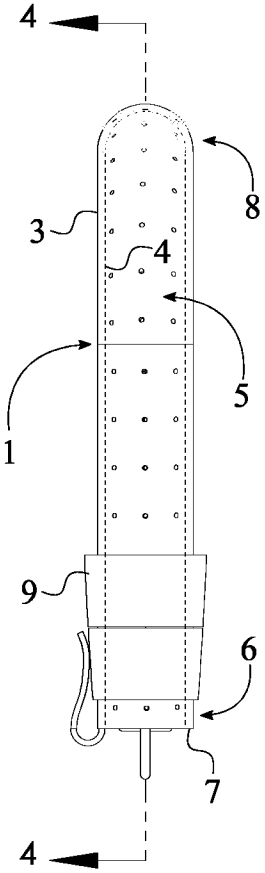
FIG. 3 is a side view of the present invention, showing the plane upon which a cross sectional view is taken shown in FIG. 4.

In reference to FIG. 1-3, the first half-mitten 1 and the second half-mitten 2 each comprise a visually accentuating outer layer 3, an inner layer 4, a finger receiving receptacle 5, and an eyelet 10. The finger receiving receptacle 5 is delineated by the inner layer 4 so that the motorist is able to insert their fingers through an opened end 6 of the finger receiving receptacle 5 as a closed end 8 of the finger receiving receptacle 5 encloses the fingers within. The visually accentuating outer layer 3 is externally connected about the inner layer 4. For example, the visually accentuating outer layer 3 can be luminous yellow, luminous green, or any other types of striking colors that can easily attract the attention of the police officer. The eyelet 10 is traverses through the visually accentuating outer layer 3 and the inner layer 4 and positioned adjacent to the opened end 6. The eyelet 10 functions as a reinforced hole within the first half-mitten 1 and the second half-mitten 2. More specifically, a metal ring, preferably brass, can be sewn over or pressed into a pre-punched hole that traverses through the visually accentuating outer layer 3 and the inner layer 4 thus combining and strengthening both layers together. Additionally, a circumference for a rim 7 of the opened end 6 is larger than a hand circumference to exclude the insertion of the motorist's thumb. More specifically, the circumference for the rim 7 and the hand circumference determine different mitten sizes (ex: small, medium, and large) to accommodate different hand sizes. For example, when the present invention is manufactured as the small size where the hand circumference is approximately 7.5 inches, the circumference for the rim 7 can be ranges from 7.5 inches to 8 inches. When the present invention is manufactured as the medium size where the hand circumference is approximately 8.5 inches, the circumference for the rim 7 can be ranges from 8.5 inches to 9 inches. When the present invention is manufactured as the large size where the hand circumference is approximately 9 inches, the circumference for the rim 7 can be ranges from 9 inches to 9.5 inches. Since the motorist is unable to insert their thumb into the finger receiving receptacle 5 and the thumb plays critical role in firing a weapon, the police officer can easily determine that the motorist is not concealing a weapon within the first half-mitten 1 and the second half-mitten 2.

In reference to FIG. 1-2, the present invention further comprises a plurality of ventilation holes 11. More specifically, the plurality of ventilation holes 11 traverses through the visually accentuating outer layer 3 and the inner layer 4 of the first half-mitten 1 and the second half-mitten 2. The plurality of ventilation holes 11 enables the air to travel in and out of the finger receiving receptacle 5 thus accommodating a comfortable environment for motorist's hands. Even though the preferred embodiment of the present invention illustrates plurality of ventilation holes 11 traversing through both the first half-mitten 1 and the second half-mitten 2, the plurality of ventilation holes 11 can traverse through either the first half-mitten 1 or the second half-mitten 2 within the present invention.

In reference to FIG. 1-2, the present invention further comprises at least one reflective strip 9. More specifically, the at least one reflective strip 9 is positioned adjacent to the opened end 6 of the first half-mitten 1 and externally encircled around the first half-mitten 1. Similarly, the at least one reflective strip 9 is positioned adjacent to the opened end 6 of the second half-mitten 2 and externally encircled around the second half-mitten 2. The at least one reflective strip 9 enables the present invention to become visible at night or in low light situations thus further enhances the visual indication of the first half-mitten 1 and/or the second half-mitten 2. Even though the preferred embodiment of the present invention illustrates two reflective strips 9 within the first half-mitten 1 and the second half-mitten 2, the number of reflective strips 9 is not limited two and can be any other number if the respective number for the reflective strips 9 improves the safety aspect of the present invention.

Figure 4:
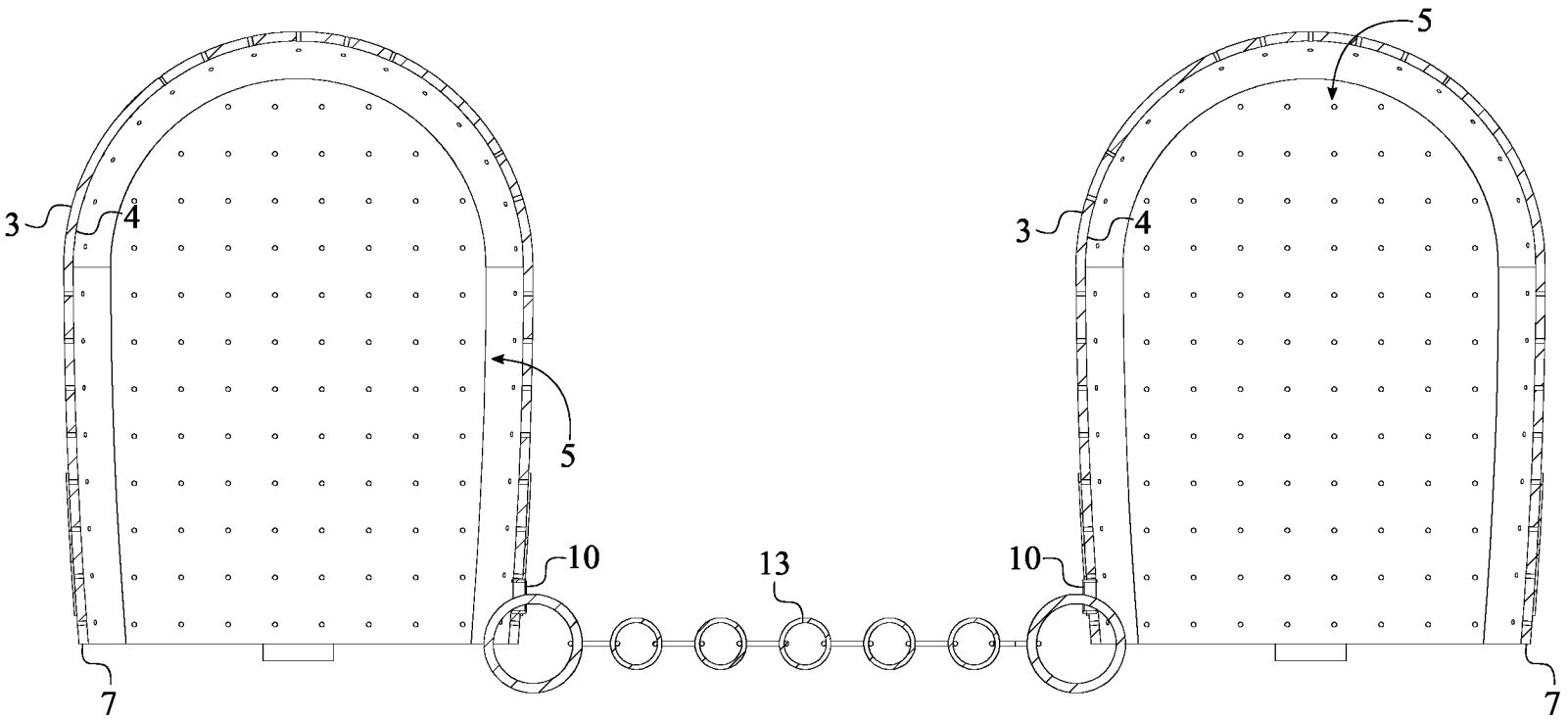
FIG. 4 is a cross section view the present invention taken along line 4-4 of FIG. 3.

In order to connect the first half-mitten 1 and the second half-mitten 2 into each other, the flexible connector 13 utilizes the eyelet 10. In reference to FIG. 4, the eyelet 10 of the first half-mitten 1 and the eyelet 10 of the second half-mitten 2 are tethered into each other by the flexible connector 13 as the flexible connector 13 can include, but is not limited to, a metal chain, a rope, and a composite strip.

Figure 5:
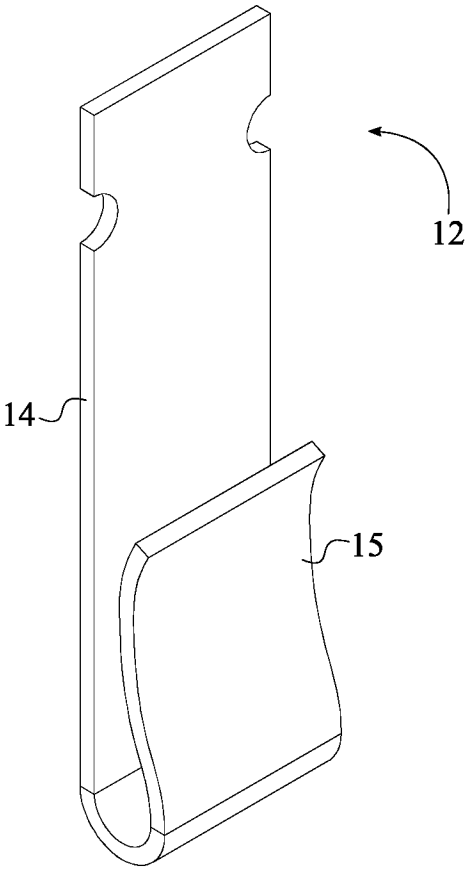
FIG. 5 is a perspective view for the clip of the present invention.
Figure 6:
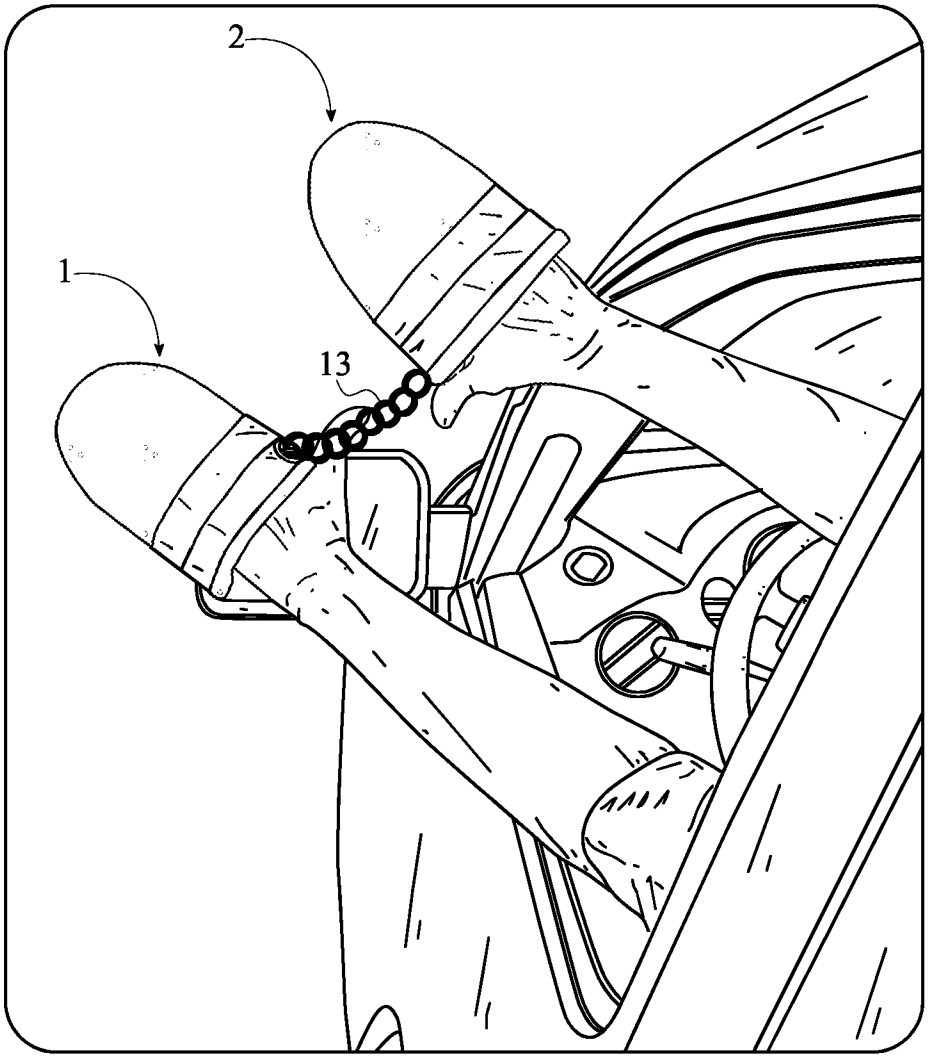
FIG. 6 is a perspective view of the present invention, wherein the present invention is worn by the motorist and both hands of the motorist is shown outside of the window during a traffic stop.

In reference to FIG. 5, the present invention further comprises a clip 12 to secure the first half-mitten 1 and/or the second half-mitten 2 to a sun visor of an automobile. As a result, the motorist can easy access to the present invention during a traffic stop. More specifically, the clip 12 comprises an attachment section 14 and a mounting section 15 as the attachment section 14 and the mounting section 15 are adjacently connected to each other. The attachment section 14 is internally connected within the visually accentuating outer layer 3 and the inner layer 4 to secure the clip 12 to the first half-mitten 1 and/or the second half-mitten 2. The mounting section 15 is then externally extended over the visually accentuating outer layer 3 and the at least one reflective strip 9 of the first half-mitten 1 and/or the second half-mitten 2 thus allowing the present invention to be secured within the sun visor. In the event of a traffic stop as shown in FIG. 6, the motorist can pull out the present invention from the sun visor, slide their fingers into the first half-mitten 1 and the second half-mitten 2, and place both hands outside of the window. The motorist can then clearly show their hands to the police officer, and the police officer is also able to clearly see the motorist's hand thus enabling the police officer to provide further instructions.

Due to the configuration of the visually accentuating outer layer 3, the at least one reflective strip 9, the shortened flexible connector 13, the present invention enhances the safety parameters within a traffic stop for the police officer and the motorist. Resultantly, present invention can drastically reduce the number of fatalities and personal injuries that are related to traffic stops.

Although the invention has been explained in relation to its preferred embodiment, it is to be understood that many other possible modifications and variations can be made without departing from the spirit and scope of the invention as hereinafter claimed.

What is claimed is:

1. A half mitten apparatus to safely demonstrate motorist hands during a traffic stop comprising:

a first half-mitten;

a second half-mitten;

a flexible connector;

the flexible connector being a metal chain;

the first half-mitten and the second half-mitten each comprising a visually accentuating outer layer, an inner layer, a single finger receiving receptacle, and an eyelet, the single finger receiving receptacle comprising an opened end and a closed end, the single finger receiving receptacle being delineated by the inner layer, the visually accentuating outer layer being externally connected about the inner layer, the eyelet traversing through the visually accentuating outer layer and the inner layer and being positioned adjacently to the opened end;

the eyelet of the first half-mitten and the eyelet of the second half-mitten being tethered into each other by the flexible connector;

at least one first reflective strip;

at least one second reflective strip;

the at least one first reflective strip being positioned adjacent to the opened end of the first half-mitten;

the at least one second reflective strip being positioned adjacent to the opened end of the second half-mitten;

the at least one first reflective strip being externally encircled around the first half-mitten; and the at least one second reflective strip being externally encircled around the second half-mitten.

2. The half mitten apparatus to safely demonstrate motorist hands during a traffic stop as claimed in claim 1 comprising:

a plurality of ventilation holes; and the plurality of ventilation holes traverses through the visually accentuating outer layer and the inner layer of the first half-mitten.

3. The half mitten apparatus to safely demonstrate motorist hands during a traffic stop as claimed in claim 1 comprising:

a plurality of ventilation holes; and the plurality of ventilation holes traverses through the visually accentuating outer layer and the inner layer of the second half-mitten.

4. The half mitten apparatus to safely demonstrate motorist hands during a traffic stop as claimed in claim 1 comprising:

a first clip;

the first clip comprising a first attachment section and a first mounting section;

the first attachment section and the first mounting section being adjacently connected to each other;

the first attachment section being internally connected within the visually accentuating outer layer and the inner layer of the first half-mitten without traversing through the visually accentuating outer layer and the inner layer of the first half-mitten;

the first mounting section being externally extended over the visually accentuating outer layer of the first half-mitten;

a second clip;

the second clip comprising a second attachment section and a second mounting section;

the second attachment section and the second mounting section being adjacently connected to each other;

the second attachment section being internally connected within the visually accentuating outer layer and the inner layer of the second half-mitten without traversing through the visually accentuating outer layer and the inner layer of the second half-mitten; and the second mounting section being externally extended over the visually accentuating outer layer of the second half-mitten.

5. The half mitten apparatus to safely demonstrate motorist hands during a traffic stop as claimed in claim 1, wherein a length of the flexible connector ranges from 6 inches to 8 inches to minimize the movement of the first half-mitten and the second half-mitten.

6. The half mitten apparatus to safely demonstrate motorist hands during a traffic stop as claimed in claim 1, wherein a circumference for a rim of the opened end is configured to be larger than a hand circumference to exclude the insertion of a thumb.

* * * * *